US011913329B1

(12) United States Patent
Zeghlache et al.

(10) Patent No.: US 11,913,329 B1
(45) Date of Patent: Feb. 27, 2024

(54) UNTETHERED LOGGING DEVICES AND RELATED METHODS OF LOGGING A WELLBORE

(71) Applicant: Saudi Arabian Oil Company, Dhahran (SA)

(72) Inventors: Mohamed Larbi Zeghlache, Dhahran (SA); Huseyin Rahmi Seren, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/949,819

(22) Filed: Sep. 21, 2022

(51) Int. Cl.
*E21B 47/12* (2012.01)
*E21B 47/26* (2012.01)
*E21B 23/00* (2006.01)

(52) U.S. Cl.
CPC ..... *E21B 47/26* (2020.05); *E21B 23/00* (2013.01); *E21B 47/138* (2020.05); *E21B 2200/08* (2020.05)

(58) Field of Classification Search
CPC ..... E21B 47/138; B63B 22/06; B63B 22/20
See application file for complete search history.

(56) References Cited

U.S. PATENT DOCUMENTS 2,092,316 A 9/1937 Lane
2,558,427 A 6/1951 Fagan
2,563,254 A 8/1951 Lewis
3,487,484 A 1/1970 Holmes
3,535,623 A 10/1970 Wood
3,885,212 A 5/1975 Herbert
4,023,092 A 5/1977 Rogers
4,187,909 A 2/1980 Erbstoesser
4,218,651 A 8/1980 Ivy
4,224,707 A * 9/1980 Mariani ..... B63C 9/00 441/16
4,258,318 A 3/1981 Furukawa et al.
4,258,568 A * 3/1981 Boetes ..... B63B 22/18 367/133
4,408,488 A 10/1983 Marshall
4,442,403 A 4/1984 Pohler
4,589,285 A 5/1986 Savit
4,611,664 A 9/1986 Osterhoudt et al.
(Continued)

FOREIGN PATENT DOCUMENTS

CA 2858051 11/2016
CN 2725529 9/2005
(Continued)

OTHER PUBLICATIONS

U.S. Appl. No. 15/143,128, Deffenbaugh et al., filed Apr. 29, 2016.
(Continued)

*Primary Examiner* — Giovanna Wright
(74) *Attorney, Agent, or Firm* — Osha Bergman Watanabe & Burton LLP

(57) ABSTRACT

An untethered device includes a housing, a magnetic actuator that is coupled to the housing, and a buoyancy device. The buoyancy device includes an attachment plate that is securable to the magnetic actuator, a degradable ballast weight that is coupled to the attachment plate, and a buoyancy-enhancing feature that is positioned adjacent to the attachment plate.

19 Claims, 6 Drawing Sheets

(56) References Cited

U.S. PATENT DOCUMENTS 4,650,281 A 3/1987 Jaeger et al.
4,754,640 A 7/1988 Fitzgerald et al.
4,777,819 A 10/1988 Hoyt et al.
4,808,925 A 2/1989 Baird
4,855,820 A 8/1989 Barbour
4,983,912 A 1/1991 Roehrlein
5,050,674 A 9/1991 Soliman et al.
5,096,277 A 3/1992 Kleinerman
5,158,440 A 10/1992 Cooper et al.
5,177,997 A 1/1993 Maciejewski
5,188,837 A 2/1993 Domb
5,219,245 A * 6/1993 Chin-Yee ..... B63C 7/22 441/2
5,241,028 A 8/1993 Tucker et al.
5,335,542 A 8/1994 Ramakrishnan et al.
5,387,863 A 2/1995 Lo
5,494,413 A 2/1996 Campen et al.
5,514,016 A * 5/1996 Larson ..... B63B 22/16 441/6
5,555,945 A 9/1996 Schultz
5,579,287 A 11/1996 Boucher et al.
5,634,426 A 6/1997 Tomlinson et al.
5,649,811 A 7/1997 Krol, Jr. et al.
5,720,345 A 2/1998 Price et al.
5,729,607 A 3/1998 DeFries et al.
5,745,833 A 4/1998 Abe et al.
5,767,668 A 6/1998 Durand
5,789,669 A 8/1998 Flaum
5,816,874 A 10/1998 Juran et al.
5,944,195 A 8/1999 Huang et al.
6,076,046 A 6/2000 Vasudevan et al.
6,084,403 A 7/2000 Sinclair et al.
6,241,028 B1 6/2001 Bijleveld et al.
6,250,848 B1 6/2001 Moridis et al.
6,380,534 B1 4/2002 Mahmoud et al.
6,411,084 B1 6/2002 Yoo
6,446,718 B1 9/2002 Barrett et al.
6,534,980 B2 3/2003 Toufaily et al.
6,555,807 B2 4/2003 Clayton et al.
6,675,892 B2 1/2004 Kuchuk
6,808,371 B2 10/2004 Niwatsukino et al.
6,811,382 B2 11/2004 Buchanan et al.
6,832,515 B2 12/2004 Follini et al.
6,853,200 B2 2/2005 Munser
6,856,132 B2 2/2005 Appel et al.
6,976,535 B2 12/2005 Aronstam et al.
7,021,905 B2 4/2006 Torrey et al.
7,024,930 B2 4/2006 Follini et al.
7,031,841 B2 4/2006 Zazivsky
7,032,661 B2 4/2006 Georgi et al.
7,036,578 B2 5/2006 Austbo et al.
7,049,272 B2 5/2006 Sinclair et al.
7,054,751 B2 5/2006 Craig
7,117,734 B2 10/2006 Follini et al.
7,168,494 B2 1/2007 Starr et al.
7,210,334 B2 5/2007 Seghers et al.
7,263,880 B2 9/2007 Pop et al.
7,290,443 B2 11/2007 Follini et al.
7,322,416 B2 1/2008 Burris et al.
7,363,967 B2 4/2008 Burris, II et al.
7,376,514 B2 5/2008 Habashy et al.
7,387,165 B2 6/2008 Lopez et al.
7,445,043 B2 11/2008 Mullins et al.
7,495,350 B2 2/2009 Pinkerton et al.
7,622,915 B2 11/2009 Sugiyama
7,788,037 B2 8/2010 Soliman et al.
7,831,205 B2 11/2010 Jack et al.
7,898,494 B2 3/2011 Brune
8,015,869 B2 9/2011 Nold, III
8,074,713 B2 12/2011 Ramos et al.
8,136,470 B1 3/2012 Buescher et al.
8,229,699 B2 7/2012 Jin
8,237,444 B2 8/2012 Simon
8,269,501 B2 9/2012 Schmidt et al.
8,272,455 B2 9/2012 Guimerans
8,584,519 B2 11/2013 Maida et al.
8,638,104 B2 1/2014 Barber et al.
8,661,907 B2 3/2014 Davis et al.
8,794,062 B2 8/2014 DiGoggio et al.
8,816,689 B2 8/2014 Colombo et al.
8,877,954 B2 11/2014 Giesenberg et al.
8,884,624 B2 11/2014 Homan et al.
8,885,559 B2 11/2014 Schmidt et al.
8,899,349 B2 12/2014 Rasmus et al.
8,981,957 B2 3/2015 Gano et al.
8,985,218 B2 3/2015 Bedouet et al.
9,033,045 B2 5/2015 Fincher
9,045,969 B2 6/2015 Waters
9,051,829 B2 6/2015 Xie
9,080,097 B2 7/2015 Gupta et al.
9,129,728 B2 9/2015 Edbury
9,133,709 B2 9/2015 Huh et al.
9,422,811 B2 8/2016 Bedouet et al.
9,477,002 B2 10/2016 Miller et al.
9,528,322 B2 12/2016 MacDonald
9,562,987 B2 2/2017 Guner et al.
9,587,477 B2 3/2017 Lafferty et al.
9,650,851 B2 5/2017 Whitsitt et al.
9,863,222 B2 1/2018 Morrow et al.
10,117,042 B2 10/2018 Akyildiz et al.
10,253,622 B2 4/2019 Jaaskelainen et al.
10,267,937 B2 4/2019 Hu
10,273,399 B2 4/2019 Cox et al.
10,301,910 B2 5/2019 Whitsitt et al.
10,308,865 B2 6/2019 Cox et al.
10,308,895 B2 6/2019 Vidal et al.
10,316,645 B2 6/2019 Ingraham et al.
10,323,644 B1 6/2019 Shakirov et al.
10,337,279 B2 7/2019 Frazier
10,349,249 B2 7/2019 Akyildiz et al.
10,364,629 B2 7/2019 Jacob et al.
10,400,584 B2 9/2019 Palomarez
10,444,065 B2 10/2019 Schmidt et al.
10,487,259 B2 11/2019 Cox et al.
10,501,682 B2 12/2019 Cox et al.
10,502,044 B2 12/2019 Fouda et al.
10,577,921 B2 3/2020 Donderici et al.
10,704,369 B2 7/2020 Zeghlache et al.
10,711,599 B2 7/2020 Jaaskelainen et al.
10,718,175 B2 7/2020 Cabot et al.
10,900,351 B2 1/2021 Deffenbaugh et al.
11,047,218 B2 6/2021 Zeghlache et al.
11,111,773 B1 9/2021 Zeghlache
11,125,061 B2 9/2021 Zeghlache et al.
11,242,743 B2 2/2022 Seren et al.
11,332,991 B2 5/2022 Seren et al.
11,391,855 B2 7/2022 Nasser et al.
11,578,590 B2 2/2023 Deffenbaugh et al.
2002/0096322 A1 7/2002 Barrett
2002/0185273 A1 12/2002 Aronstam et al.
2003/0052670 A1 3/2003 Miszewski
2003/0220204 A1 11/2003 Baran et al.
2003/0233873 A1 12/2003 Standen
2004/0108110 A1 6/2004 Zupanick
2004/0236512 A1 11/2004 DiFoggio et al.
2005/0152280 A1 7/2005 Pollin
2005/0241824 A1 11/2005 Burris et al.
2005/0241825 A1 11/2005 Burris
2006/0076956 A1 4/2006 Sjolie et al.
2006/0090893 A1 5/2006 Sheffield
2006/0105052 A1 5/2006 Acar et al.
2006/0157239 A1 7/2006 Ramos et al.
2006/0213662 A1 9/2006 Creel et al.
2007/0051512 A1 3/2007 Markel et al.
2007/0079652 A1 4/2007 Craig
2007/0083331 A1 4/2007 Craig
2007/0114030 A1 5/2007 Todd et al.
2007/0277970 A1 12/2007 Botnmark
2008/0008043 A1 1/2008 Jong
2008/0047337 A1 2/2008 Chemali et al.
2008/0290876 A1 11/2008 Ameen
2009/0173504 A1 7/2009 McElhinney
2009/0222921 A1 9/2009 Mukhopadhyay et al.
2009/0250207 A1 10/2009 May

(56) References Cited

U.S. PATENT DOCUMENTS

| | | | |
|---|---|---|---|
| 2009/0254171 | A1 | 10/2009 | Heikkila |
| 2009/0255669 | A1 | 10/2009 | Ayan et al. |
| 2009/0264067 | A1 | 10/2009 | Pahlavan |
| 2009/0264768 | A1 | 10/2009 | Courtney |
| 2009/0277625 | A1 | 11/2009 | Bai et al. |
| 2009/0289627 | A1 | 11/2009 | Johansen et al. |
| 2009/0302847 | A1 | 12/2009 | Knizhnik |
| 2010/0191110 | A1 | 7/2010 | Insana et al. |
| 2010/0200744 | A1 | 8/2010 | Pearce et al. |
| 2010/0227557 | A1 | 9/2010 | Won et al. |
| 2010/0241407 | A1 | 9/2010 | Hsu et al. |
| 2010/0268470 | A1 | 10/2010 | Kamal et al. |
| 2011/0030949 | A1 | 2/2011 | Weaver et al. |
| 2011/0221443 | A1 | 2/2011 | Bittar |
| 2011/0100634 | A1 | 5/2011 | Williamson |
| 2011/0253373 | A1 | 10/2011 | Kumar et al. |
| 2011/0264429 | A1 | 10/2011 | Lee et al. |
| 2012/0085538 | A1 | 4/2012 | Guerrero et al. |
| 2012/0092960 | A1 | 4/2012 | Gaston et al. |
| 2012/0111559 | A1 | 5/2012 | Deady et al. |
| 2012/0135080 | A1 | 5/2012 | Bromberg et al. |
| 2012/0281643 | A1 | 11/2012 | Sun |
| 2012/0285695 | A1 | 11/2012 | Lafferty et al. |
| 2013/0043887 | A1 | 2/2013 | Ziolkowski et al. |
| 2013/0073208 | A1 | 3/2013 | Dorovsky |
| 2013/0091292 | A1 | 4/2013 | Kim et al. |
| 2013/0109261 | A1 | 5/2013 | Koene |
| 2013/0118807 | A1 | 5/2013 | Yang |
| 2013/0186645 | A1 | 7/2013 | Hall |
| 2013/0192349 | A1 | 8/2013 | Ramkumar et al. |
| 2013/0192823 | A1 | 8/2013 | Barrilleaux et al. |
| 2013/0244914 | A1 | 9/2013 | Wu et al. |
| 2013/0250812 | A1 | 9/2013 | Rath |
| 2013/0296453 | A1 | 11/2013 | Giesenberg et al. |
| 2013/0312970 | A1 | 11/2013 | Lafitte et al. |
| 2013/0332015 | A1 | 12/2013 | Dextreit et al. |
| 2013/0333872 | A1 | 12/2013 | McMillon et al. |
| 2013/0341030 | A1 | 12/2013 | Brannon et al. |
| 2014/0036628 | A1 | 2/2014 | Hill et al. |
| 2014/0041862 | A1 | 2/2014 | Ersoz |
| 2014/0060832 | A1 | 3/2014 | Mahoney et al. |
| 2014/0076542 | A1 | 3/2014 | Whitsitt et al. |
| 2014/0110102 | A1 | 4/2014 | Hall |
| 2014/0133276 | A1 | 5/2014 | Volker |
| 2014/0159715 | A1 | 6/2014 | McEwen-King |
| 2014/0182844 | A1 | 7/2014 | Wutherich et al. |
| 2014/0190700 | A1 | 7/2014 | Tang et al. |
| 2014/0200511 | A1 | 7/2014 | Boyden |
| 2014/0262232 | A1 | 9/2014 | Dusterhoft et al. |
| 2014/0366069 | A1 | 12/2014 | Ramamurthi |
| 2015/0000657 | A1 | 1/2015 | Varvello et al. |
| 2015/0013983 | A1 | 1/2015 | Alwattari |
| 2015/0036482 | A1 | 2/2015 | Schmidt et al. |
| 2015/0050741 | A1 | 2/2015 | Tour et al. |
| 2015/0075777 | A1 | 3/2015 | Walters et al. |
| 2015/0075778 | A1 | 3/2015 | Walters et al. |
| 2015/0075779 | A1 | 3/2015 | Walters et al. |
| 2015/0094964 | A1 | 4/2015 | Kuroda et al. |
| 2015/0101798 | A1 | 4/2015 | Buytaert et al. |
| 2015/0107855 | A1 | 4/2015 | Murphree et al. |
| 2015/0118501 | A1 | 4/2015 | Lu |
| 2015/0159079 | A1 | 6/2015 | Huh et al. |
| 2015/0181315 | A1 | 6/2015 | Vuran et al. |
| 2015/0192436 | A1 | 7/2015 | Farhadiroushan et al. |
| 2015/0264627 | A1 | 9/2015 | Perdomo et al. |
| 2015/0268370 | A1 | 9/2015 | Johnston et al. |
| 2015/0275649 | A1 | 10/2015 | Orban et al. |
| 2015/0319630 | A1 | 11/2015 | Kerberg |
| 2015/0337874 | A1 | 11/2015 | Park |
| 2015/0338541 | A1 | 11/2015 | Nichols et al. |
| 2015/0368547 | A1 | 12/2015 | Lesko et al. |
| 2015/0376493 | A1 | 12/2015 | Huh et al. |
| 2016/0025961 | A1 | 1/2016 | Tripathy |
| 2016/0040514 | A1 | 2/2016 | Rahmani et al. |
| 2016/0069163 | A1 | 3/2016 | Tolman |
| 2016/0083641 | A1 | 3/2016 | Gamage |
| 2016/0109611 | A1 | 4/2016 | Simon |
| 2016/0138964 | A1 | 5/2016 | Brengartner et al. |
| 2016/0146662 | A1 | 5/2016 | Stokely et al. |
| 2016/0168974 | A1 | 6/2016 | Donderici |
| 2016/0168984 | A1 | 6/2016 | Fripp |
| 2016/0194954 | A1 | 7/2016 | Hay |
| 2016/0251935 | A1 | 9/2016 | Jacob et al. |
| 2016/0264846 | A1 | 9/2016 | Bennetzen et al. |
| 2016/0305447 | A1 | 10/2016 | Dreiss et al. |
| 2016/0320769 | A1* | 11/2016 | Deffenbaugh ..... E21B 23/10 |
| 2017/0067328 | A1 | 3/2017 | Chauffe et al. |
| 2017/0074093 | A1 | 3/2017 | Adebayo |
| 2017/0138187 | A1 | 5/2017 | Moronkeji et al. |
| 2017/0101865 | A1 | 6/2017 | Khalaj Amineh et al. |
| 2018/0292558 | A1 | 10/2018 | Wilson et al. |
| 2018/0306027 | A1 | 10/2018 | Sherman |
| 2018/0313735 | A1 | 11/2018 | Gallagher |
| 2018/0320059 | A1 | 11/2018 | Cox et al. |
| 2018/0328170 | A1 | 11/2018 | Jaaskelainen et al. |
| 2018/0334903 | A1 | 11/2018 | Lehr |
| 2018/0363409 | A1 | 12/2018 | Frazier |
| 2018/0371886 | A1 | 12/2018 | Zeghlache et al. |
| 2019/0040734 | A1 | 2/2019 | Donderici et al. |
| 2019/0226900 | A1 | 7/2019 | Brengartner et al. |
| 2020/0400013 | A1 | 12/2020 | McBride |
| 2021/0017827 | A1 | 1/2021 | Seren et al. |
| 2021/0041591 | A1 | 2/2021 | Riachentsev |
| 2021/0140311 | A1 | 5/2021 | Deffenbaugh et al. |
| 2021/0208046 | A1 | 7/2021 | Gonzalez et al. |
| 2022/0010648 | A1 | 1/2022 | Musso et al. |
| 2022/0127953 | A1 | 4/2022 | Seren et al. |
| 2022/0243583 | A1 | 8/2022 | Seren et al. |
| 2022/0334286 | A1 | 10/2022 | Seren et al. |
| 2023/0038860 | A1 | 2/2023 | Seren et al. |

FOREIGN PATENT DOCUMENTS

| | | |
|---|---|---|
| CN | 102268986 | 12/2011 |
| CN | 103441803 | 12/2013 |
| CN | 103701567 | 4/2014 |
| CN | 108112260 | 6/2018 |
| CN | 215565894 | 1/2022 |
| DE | 4419684 | 12/1995 |
| EP | 1181435 | 2/2002 |
| EP | 1721603 | 11/2006 |
| EP | 2163724 | 3/2010 |
| EP | 2789793 | 10/2014 |
| EP | 2801696 | 11/2014 |
| EP | 2954151 | 12/2015 |
| EP | 3196402 | 7/2017 |
| EP | 3289179 | 3/2018 |
| GB | 2306657 | 5/1997 |
| GB | 2442745 | 4/2011 |
| IN | 397521 | 5/2022 |
| JP | 2000065659 | 3/2000 |
| JP | 2002233270 | 8/2002 |
| JP | 2004290096 | 10/2004 |
| JP | 2008237167 | 10/2008 |
| JP | 6518342 | 5/2019 |
| KR | 10-2023741 | 9/2019 |
| RU | 2025747 | 12/1994 |
| WO | WO 1998046857 | 10/1998 |
| WO | WO 2000023824 | 4/2000 |
| WO | WO 0073625 | 12/2000 |
| WO | WO 2004113677 | 12/2004 |
| WO | WO 2009004336 | 1/2009 |
| WO | WO 2011063023 | 5/2011 |
| WO | WO 2011097063 | 8/2011 |
| WO | WO 2011146866 | 11/2011 |
| WO | WO 2012154332 | 11/2012 |
| WO | WO 2012158478 | 11/2012 |
| WO | WO 2012173608 | 12/2012 |
| WO | WO 2013126388 | 8/2013 |
| WO | WO 2013142869 | 9/2013 |
| WO | WO 2014049698 | 4/2014 |
| WO | WO 2014066793 | 5/2014 |
| WO | WO 2014100275 | 6/2014 |
| WO | WO 2015020642 | 2/2015 |

(56) References Cited

FOREIGN PATENT DOCUMENTS

| | | |
|---|---|---|
| WO | WO 2015044446 | 4/2015 |
| WO | WO 2015084926 | 6/2015 |
| WO | WO 2015086062 | 6/2015 |
| WO | WO 2015095168 | 6/2015 |
| WO | WO 2015134705 | 9/2015 |
| WO | WO 2016176643 | 11/2016 |
| WO | WO 2017196357 | 11/2017 |
| WO | WO 2017205565 | 11/2017 |
| WO | WO 2018022198 | 2/2018 |
| WO | WO 2018084865 | 5/2018 |
| WO | WO 2019195923 | 10/2019 |
| WO | WO 2020117231 | 6/2020 |
| WO | WO 2020220087 | 11/2020 |
| WO | WO 2020257742 | 12/2020 |
| WO | WO 2021257339 | 12/2021 |
| WO | WO 2022011388 | 1/2022 |

OTHER PUBLICATIONS

U.S. Appl. No. 17/164,067, Seren et al., filed Feb. 1, 2021.
U.S. Appl. No. 17/234,555, Seren et al., filed Apr. 19, 2021.
U.S. Appl. No. 17/394,813, Seren et al., filed Aug. 5, 2021.
U.S. Appl. No. 17/538,739, Zeghlache, filed Nov. 30, 2021.
U.S. Appl. No. 17/949,819, Zeghlache et al., filed Sep. 21, 2022.
Agbinya, "A Magneto-Inductive Link Budget for Wireless Power Transfer and Inductive Communication Systems," Progress in Electromagnetics Research C, 2013, 37: 15-28, 14 pages.
Agbinya, "Investigation of Near Field Inductive Communication System Models, Channels and Experiments, " Progress in Electromagnetics Research B, 2013, 49: 129-153, 25 pages.
Akyildiz et al., "SoftWater: Software-Defined Networking for Next-Generation Underwater Communication Systems," Ad Hoc Networks, Apr. 8, 2016, 46: 1-11, 11 pages.
Al Macki et al., "Electromagnetic Corrosion Logs, Insights from Yard Test," SPE-188672-MS, Society of Petroleum Engineers, presented at the Abu Dhabi International Petroleum Exhibition and Conference in Abu Dhabi, UAE, Nov. 13-16, 2017, 9 pages.
Alverez et al., "Design, realization and field results of an inductive casing collar locator," IEEE Sensors Applications Symposium (SAS), Apr. 12, 2017, 4 pages.
Alverez et al., "Theory, Design, Realization, and Field Results of an Inductive Casing Collar Locator," IEEE Transactions on Instrumentation and Measurement, Apr. 2018, 67(4):760-766, 7 pages.
americanpiezo.com [online], "Stripe Actuators," available on or before Mar. 13, 2011, via Internet Archive: Wayback Machine URL <https://web.archive.org/web/20110313073802/https://www.americanpiezo.com/standard-products/stripe-actuators.html>, [retrieved on Apr. 6, 2018], retrieved from: URL <https://www.americanpiezo.com/standard-products/stripe-actuators.html>, 2 pages.
Assaf et al., "Accurate Sensors Localization in Underground Mines or Tunnels," IEEE, 2015, 6 pages.
Bagaria et al., "Iron Oxide Nanoparticles Grafted with Sulfonated Copolymers are Stable in Concentrated Brine at Elevated Temperatures and Weakly Adsorb on Silica," ACS Applied Materials & Interfaces, Mar. 25, 2013, 5:8 (3329-3339), 11 pages.
Baker et al., "Permanent monitoring-looking at lifetime reservoir dynamics," Oilfield Review, 1995, 7:4 (32-46), 15 pages.
Bala et al., "Interaction of Different Metal Ions with Carboxylic Acid Group: A Quantitative Study," The Journal of Physical Chemistry A, Jun. 2007, 111:28 (6183-6190), 8 pages.
Bar-Kochba et al., "A Fast Iterative Digital Volume Correlation Technique for Large Deformation Measurements," Experimental Mechanics, Feb. 2014, 55: 261-274, 14 pages.
bayspec.com [online], "SuperGamut NIR Spectrometer," available on or before Feb. 2014, [retrieved Apr. 18, 20180], retrieved from: URL <http://www.bayspec.com/wp-content/uploads/2014/02/BaySpec-Datasheet-nir-swir.pdf>, 6 pages.
Bell et al., "Subsurface Discrimination Using Electromagnetic Induction Sensors," IEEE Transactions on Geoscience and Remote Sensing, Jun. 2001, 39:6, 8 pages.
Biswas et al., "Semidefinite Programming Approaches for Sensor Network Localization with Noisy Distance Measurements," IEEE Trans. on Automation Science and Engineering, Oct. 2006, 3:4 (360-371), 12 pages.
Blunt, "Effects of heterogeneity and wetting on relative permeability using pore level modeling", SPE Journal 2:01 (70-87), Mar. 1997, 19 pages.
Boman, "DAS technology expands fiber optic applications for oil, gas industry," Rigzone, May 4, 2015, 4 pages.
Bryant and Blunt, "Prediction of relative permeability in simple porous media" Phys. Rev. A, Aug. 1992, 46:4 (2004-2011), 8 pages.
bubbletightusa.com [online], "Innovative Materials," 2022, retrieved on Feb. 14, 2022, retrieved from URL <http://bubbletightusa.com/products/>, 9 pages.
Buljac et al., "Digital vol. correlation: review of progress and challenges," Experimental Mechanics, 58:5, 2018, 661-708, 127 pages.
Buzi et al., "Sensor Ball: An Autonomous Untethered Logging Platform," OTC-30538-MS, Paper presented at the Offshore Technology Conference, Houston, Texas, USA, May 2020, 10 pages.
Buzi et al., "Sensor Ball: Modernized Logging." SPE-204791-MS, Society of Petroleum Engineers, Dec. 2021, 6 pages.
Buzi et al., "Sensor Ball: Autonomous, intelligent logging platform," OTC-31149-MS, Offshore Technology Conference, Aug. 2021, 13 pages.
Campbell et al., "Vertical seismic profiles—More than just a corridor stack," The Leading Edge, Jul. 2005, 24(7):694-697, 4 pages.
Chappell and Lancaster, "Comparison of methodological uncertainties within permeability measurements" Hydrological Processes, Jan. 2007, 21:18 (2504-2514), 11 pages.
Chen et al., "Aggregation Kinetics of Alginate-Coated Hematite Nanoparticles in Monovalent and Divalent Electrolytes," Environmental Science & Technology, Mar. 2006, 40:5 (1516-1523), 8 pages.
Chen et al., "Distributed Source Localization in Wireless Underground Sensor Networks," arXIiv: 1112.4035v1, Dec. 17, 2011, 21 pages.
Chen et al., "Hydration Repulsion between Carbohydrate Surfaces Mediated by Temperature and Specific Ions," Scientific Reports, Jun. 23, 2016, 6: 1-10, 10 pages.
Chen et al., "Synthesis of Disruptive Technologies Leads to Design of Flowable Sensors for Reservoir Monitoring, Passively Retrievable Through Carrier Buoyancy," OTC-29599-MS, prepared for presentation at the Offshore Technology Conference held in Houston, Texas, USA, May 6-9, 2019, 12 pages.
Cole et al., "Polyethylene Glycol Modified, Cross-Linked Starch-Coated Iron Oxide Nanoparticles for Enhanced Magnetic tumor Targeting," Biomaterials, Mar. 1, 2011, 32:8 (2183-2193), 11 pages.
Colombo and McNeice, "Quantifying surface-to-reservoir electromagnetics for waterflood monitoring in a Saudi Arabian carbonate reservoir," Geophysics, Nov. 2013, 78:6, 17 pages.
commons.wikimedia.org [online], "File:6DOF.svg" Feb. 2015, [retrieved on Apr. 7, 2021], retrieved from: URL <https://commons.wikimedia.org/w/index.php?curid=38429678>, 4 pages.
Costa et al., "Distributed Weighted-Multidimensional Scaling for Node Localization in Sensor Networks," ACM Trans. Sen. Netw., Feb. 2006, 2:1 (39-64), 26 pages.
Cui et al., "Cross-Layer Energy and Delay Optimization in Small-Scale Sensor Networks," IEEE Transactions on Wireless Communications, Oct. 2007, 6:10, 12 pages.
Danfoss, "Facts Worth Knowing about Frequency Converters," Handbook VLT Frequency Converters, Danfoss Engineering Tomorrow, 180 pages.
De et al., "An Integrated Cross-Layer Study of Wireless CDMA Sensor Networks," IEEE Journal on Selected Areas in Communications, Sep. 2004, 22:7, 15 pages.
Deffenbaugh et al., "An Untethered Sensor for Well Logging, " IEEE Sensors Applications Symposium (SAS), Mar. 2017, 5 pages.
Delmonte, "Molding and Casting of Metal/Polymer Composites," Metal/polymer composites, Springer, 1990, 37 pages.
DiCarlo et al., "Three-phase relative permeability of water-wet, oil-wet, and mixed-wet sandpacks" SPE Journal, Mar. 2000, 5:01 (82-91), 10 pages.

(56) References Cited

OTHER PUBLICATIONS

Dixit et al., "A pore-level investigation of relative permeability hysteresis in water-wet systems" SPE Journal, Jun. 1998, 3:02 (115-123), 9 pages.
elprocus.com [online], "Designing of 12V to 24V DC Converter Circuit using LM324," available on or before 2013, retrieved from URL <https://www.elprocus.com/12v-to-24v-dc-converter-using-lm324/>, retrieved on Aug. 11, 2021, 7 pages.
Estrada et al., "Intuitive Interface for the Quantitative Evaluation of Speckle Patterns for Use in Digital Image and Volume Correlation Techniques," J. Applied Mechanics, 82:9 (095001), Sep. 2015, 5 pages.
Fatt, "The network model of porous media" Petroleum Transactions, Dec. 1956, 207: 144-181, 38 pages.
Gahlin et al., "The particle size effect in abrasion studied by controlled abrasive surfaces," Wear, Jan. 1999, 224(1):118-125, 8 pages.
Garcia et al., "Successful Application of a New Electromagnetic Corrosion Tool for Well Integrity Evaluation in Old Wells Complete with Reduced Diameter Tubular," IPTC.16997, International Petroleum Technology Conference, Beijing, China, Mar. 26-28, 2013, 12 pages.
Gardner et al., "Barrier Verification During Plug and Abandonment Using Spectral Noise Logging Technology, Reference Cells Yard Test," Society of Petroleum Engineers, SPE/IADC-194075-MS, SPE/IASDC Drilling International Conference and Exhibition in the Hauge, the Netherlands, Mar. 5-7, 2019, 22 pages.
Gasda et al., "Wellbore Permeability Estimates from Vertical Interference Testing of Existing Wells," Energy Procedia, vol. 37, Jan. 1, 2013, 8 pages.
Gulbahar et al., "A Communication Theoretical Modeling and Analysis of Underwater Magneto-Inductive Wireless Channels," IEEE Transactions on Wireless Communications, Sep. 2012, 11:9, 9 pages.
Heiba et al., "Percolation theory of two-phase relative permeability" SPE Reservoir Eng. 7:01 (123-132), Feb. 1992, 11 pages.
Hui and Blunt, "Effects of wettability on three-phase flow in porous media" J. Phys. Chem. 104:16 (3833-3845), Feb. 2000, 13 pages.
Hunting-intl.com [online], "Mechanical Centralizers and Decentralizers" Mar. 2015, [retrieved on Apr. 7, 2021], retrieved from: URL <http://www.hunting-intl.com/titan/wireline-hardware-and-accessories/mechanical-centralizers-and-decentralizers>, 1 page.
Jacobs et al., "Downhole fiber-optic monitoring: an evolving technology," Society of Petroleum Engineers, Journal of Petroleum Technology, Aug. 2014, 66:08, Abstract only, 2 pages.
Ji et al., "Beyond Convex Relaxation: A Polynomial-Time Non-Convex Optimization Approach to Network Localization," Proceedings IEEE Infocom, Apr. 2013, 2499-2507, 9 pages.
Kannan et al., "Analysis of Flip Ambiguities for Robust Sensor Network Localization," IEEE Trans. Veh. Technol., May 2010, 59:4 (2057-2070), 14 pages.
Karalis, "Efficient Wireless Non-Radiative Mid-Range Energy Transfer," Annals of Physics, 2008, 323: 34-48, 15 pages.
Kim et al., "Development of the inpipe robot for various sizes," 2009 IEEE/ASME International Conference on Advanced Intelligent Mechatronics, Jul. 2009, 5 pages.
Kisseleff et al., "Throughput of the Magnetic Induction Based Wireless Underground Sensor Networks: Key Optimization Techniques," IEEE Transactions on Communications, Dec. 2014, 62:12, 14 pages.
Knaian, "Electropermanent magnetic connectors and actuators: devices and their application in programmable matter," PhD thesis, Massachusetts Institute of Technology, 2010, 206 pages.
Kramer, "Water-Soluble Dendritic Architectures with Carbohydrate Shells for the Templation and Stabilization of Catalytically Active Metal Nanoparticles," published by ACS, Macromolecules, Aug. 27, 2005, 38:20 (8308-8315), 8 pages.
Kuchuk et al., "The use of Vertical Interference Testing to improve reservoir interference testing to improve reservoir characterization, " SPE, Oct. 18, 2000, 13 pages.
Li et al., "In Situ Estimation of Relative Permeability from Resistivity Measurements," Petroleum Geoscience, 2014, 20: 143-151, 10 pages.
Li, "Collaborative Localization with Received-Signal Strength in Wireless Sensor Networks," IEEE Trans. Veh. Technol., Nov. 2007, 56:6 (3807-3817), 11 pages.
Lin et al., "A Tutorial on Cross-Layer Optimization in Wireless Networks," IEEE Journal on Selected Areas in Communications, Aug. 2006, 24:8, 12 pages.
Lin et al., "Magnetic Induction-Based Localization in Randomly-Deployed Wireless Underground Sensor Networks," IEEE Internet of Things Journal, Jul. 20, 2017, 1-11, 11 pages.
Liu et al, "Acoustic Wave-Based Method of Locating Tubing Leakage for Offshore Gas Wells", Energies, MDPI, 2018, 11, 3454, 21 pages.
Liu et al., "Down-hole robots: current status, challenge and innovation," 2013 IEEE International Conference on Mechatronics and Automation, Aug. 2013, 5 pages.
machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/article/21832406/motors-for-efficiency-permanentmagnet-reluctance-and-induction-motors-compared>, 4 pages.
Mahmud et. al "Effect of network topology on two-phase imbibition relative permeability" Transport in Porous Media, Feb. 2007, 66:3 (481-493), 14 pages.
Martinez et al., "Polysaccharide-based Nanoparticles for Controlled Release Formulations," The Delivery of Nanoparticles, May 2012, 185-222, 39 pages.
Masihpour et al., "Multihop Relay Techniques for Communication Range Extension in Near-Field Magnetic Induction Communication Systems," Journal of Networks, May 2013, 8:5, 13 pages.
Nagy et. al, "Comparison of permeability testing methods," Proceedings of the 18th International Conference on Soil Mechanics and Geotechnical Engineering, 2013, 399-402, 4 pages.
Nie, "Sum of Squares Method for Sensor Network Localization," Computational Optimization and Applications, 2007, 43:2 (151-179), 29 pages.
Niewiadomska-Szynkiewicz, "Localization in Wireless Sensor Networks: Classification and Evaluation of Techniques," Int. J. Appl. Mat. Comput. Sci., 2012, 22:2 (281-297), 17 pages.
Ojo et al., "Water Quality Measurements using a Novel Buoyancy Controlled Drifting Sensor Platform (BcDSP)," Syracuse Center of Excellence, Clarkson University, CARTI Presentation, Apr. 2010, 27 pages.
Olofsson et al., "Ensuring correct clock timing in ocean bottom node acquisition," SEG Annual Meeting, Oct. 2010, 5 pages.
Optasense.com [online], "Oilfield Services," available on or before Jun. 2, 2015, via Wayback Machine URL <https://web.archive.org/web/20150602040413/http://www.optasense.com/our-solutions/oilfield-services/>, [retrieved Apr. 6, 2018], retrieved from URL <http://www.optasense.com/our-solutions/oilfield-services/>, 1 page.
petrowiki.spe.org [online], "Seismic profiling," Jun. 2015, retrieved Sep. 14, 2022, retrieved from URL <https://petrowiki.spe.org/Seismic_profiling>, 11 pages.
Pettitt-Schieber et al., "Testing Electromagnetic Multi-Pipe Thickness Tools in Azimuthally Constrained Defects for Deepwater Applications," Society of Petroleum Engineers, SPE-199870-MS, official proceedings for SPE/ICoTA Well Intervention Conference and Exhibition, Mar. 16, 2020, 12 pages.
piceramic.com [online], "Rectangular Bending Elements," available on or before Mar. 31, 2017, via Internet Archive: Wayback Machine URL <https://web.archive.org/web/20170331054949/https://www.piceramic.com/en/products/piezoceramic-components/bending-elements/>, [retrieved Apr. 6, 2018], retrieved from: URL <https://www.piceramic.com/en/products/piezoceramic-components/bending-elements/>, 2 pages.
Polyakov et al., "Dependence of magnetic permeability of ferromagnetic powder materials on particle size," Powder Metallurgy and Metal Ceramics, 1995, 33: 9-10, 2 pages.

(56) References Cited

OTHER PUBLICATIONS

Pompili et al., "A Multimedia Cross-Layer Protocol for Underwater Acoustic Sensor Networks," IEEE Transactions on Wireless Communications, Sep. 2010, 9:9, 10 pages.
Purcell, "Capillary pressures—their measurement using mercury and the calculation of permeability therefrom" Journal of Petroleum Technology, Feb. 1949, 1:02 (39-48), 10 pages.
Rahmani et al., "Characterizing Reservoir Heterogeneities Using Magnetic Nanoparticles," SPE Reservoir Simulation Symposium, May 2015, 25 pages.
Rio-lasers.com [online], "Redfern Integrated Optics (RIO) Colorado Tunable Laser Source," available on or before Sep. 1, 2016, via Wayback Machine URL <https://web.archive.org/web/20160901172454/http://www.rio-lasers.com/pdf/Rio_Colorado_Product%20Brief_1.24.14.pdf> [retrieved Apr. 6, 2018], retrieved from URL <http://www.rio-lasers.com/pdf/Rio_Colorado_Product Brief_1.24.14.pdf>, 2 pages.
Roy et al., "Strategic Alliance Enables Fast-Track Engineering and Expeditious Deployment of Novel Flowable Sensors & Water Reactive Nano-Composite Plugs in Mena," OTC-31118-MS, Offshore Technology Conference, 2021, 16 pages.
Saeki et al., "Upper and lower critical solution temperatures in poly (ethylene glycol) solutions," Polymer, Aug. 1976, 17:8 (685-689), 5 pages.
Sbl.com [online], "Distributed Acoustic Sensing Technology," available on or before Feb. 11, 2017, via Wayback Machine URL <https://web.archive.org/web/20170211002616/https://www.slb.com/services/characterization/geophysics/wireline/distributed-acoustic-seismic-sensing.aspx>, [retrieved on Apr. 6, 2018], retrieved from URL <https://www.slb.com/services/characterization/geophysics/wireline/distributed-acoustic-seismic-sensing.aspx>, 1 page.
Sedlar et al., "Optical fiber magnetic field sensors with ceramic magnetostrictive jackets," Applied Optics, Sep. 20, 1996, 35:27, Abstract only, 2 pages.
Seren et al., "Acoustic communication through well-head for untethered autonomous logging tool," The Journal of the Acoustical Society of America, 2020, 148, 2769, Abstract only, 4 pages.
Seren et al., "An Untethered Sensor Platform for Logging Vertical Wells," IEEE Transactions on Instrumentation and Measurement, Apr. 2018, 67(4), 6 pages.
Seren et al., "Autonomous Well Logging Robot with Passive Locomotion," 21st International Conference on Control, Automation and Systems (ICCAS), Dec. 2021, Abstract only, 3 pages.
Seren et al., "Electro-permanent magnetic weight release mechanism for buoyancy control of an autonomous well-logging tool," AIP Advances, Feb. 2021, 11(2):025117, 8 pages.
Seren et al., "Miniaturized Casing Collar Locator for Small Downhole Robots," IEEE Sensors Letters 6.4, Mar. 2022, 4 pages.
Seren et al., "Untethered Well Logging Robot," Aramco Services Company, 2021, Summary, 1 page.
Seren et al., "Wireless Communication and Charging for an Untethered Downhole Logging Tool," IEEE Sensors, Oct. 27-30, 2019, 3 pages.
ShamsiJazeyi et al., "Polymer-Coated Nanoparticles for Enhance Oil Recovery," Journal of Applied Polymer Science, Aug. 5, 2014, 131:15, 13 pages.
Shi et al., "Development and field evaluation of a distributed microchip downhole measurement system," SPE Digital Energy Conference and Exhibition, Mar. 2015, 14 pages.
Simonetto et al., "Distributed Maximum Likelihood Sensor Network Localization," IEEE Transactions on Signal Processing, Mar. 15, 2014, 62:6 (1424-1437), 14 pages.
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017, 20 pages.
steminc.com [online], "Piezo Ceramic Plate 26x8x0.7mm 108 KHz," available on or before Dec. 30, 2013, via Internet Archive Wayback Machine URL <https://web.archive.org/web/20131230010212/https://www.steminc.com/PZT/en/piezo-ceraminc-plate-26x8x7mm-108-khz>, [retrieved on Apr. 6, 2018], retrieved from URL <https://www.steminc.com/PZT/en/piezo-ceraminc-plate-26x8x7mm-108-khz>, 1 page.
Sun et al., "Design of the fiber optic distributed acoustic sensor based on Michelson interferometer and its location application," Optical Engineering, 42, Oct. 1, 2003, Abstract only, 1 page.
Sun et al., "Optimal Deployment for Magnetic Induction-Based Wireless Networks in Challenged Environments," IEEE Transactions on Wireless Communications, Mar. 2013, 12:3, 10 pages.
tervesinc.com [online], "Dissolvables," 2017, retrieved on Feb. 14, 2022, retrieved from URL <https://www.tervesinc.com/products/dissolvables/>, 6 pages.
Udd, "An overview of fiber-optic sensors," Review of Science Instruments, Jun. 1995, 66: 4015, 16 pages, Abstract only, 16 pages.
Ukrainczyk et al., "Thermophysical comparison of five commercial paraffin waxes as latent heat storage materials," Chemical and Biochemical Engineering Quarterly 24.2, 2010, 129-137, 9 pages.
Varela et al., "Wireless Advanced Nano-Devices for Well Monitoring," Abu Dhabi International Petroleum Exhibition & Conference, Nov. 2020, 18 pages.
Vuran et al., "Communication Through Soil in Wireless Underground Sensor Networks—Theory and Practice," 2010, 309-347, 39 pages.
Vuran et al., "XLP: A Cross-Layer Protocol for Efficient Communication in Wireless Sensor Networks," IEEE Transactions on Mobile Computing, Nov. 2010, 9:11, 14 pages.
Wikipedia.com [online], "Distributed acoustic sensing", Jan. 17, 2012, [retrieved on Feb. 23, 2018], retrieved from URL <https://en.wikipedia.org/wiki/Distributed_acoustic_sensing>, 5 pages.
Wikipedia.org [online], "Metacentric Height" Nov. 2003, [retrieved on Apr. 7, 2021], retrieved from: URL <https://en.wikipedia.org/wiki/Metacentric_height>, 7 pages.
Yamamoto, "Imaging the permeability structure within the near-surface sediments by acoustic crosswell tomography," Journal of Applied Geophysics, 47:1, May 2001, 11 pages.
Zeghlache et al., "An Innovative Deployment Technique to Optimize Logging Conveyance and Improve Data Quality," IPTC-21206-MS, International Petroleum Technology Conference, 2021, 16 pages.
Zeghlache et al., "Sensor-Ball: Field deployment of autonomous and untethered surveillance." IPTC-22255-MS, International Petroleum Technology Conference, Feb. 21-23, 2022, Abstract Only, 6 pages.
Zhan et al., "Characterization of Reservoir Heterogeneity Through Fluid Movement Monitoring with Deep Electromagnetic and Pressure Measurements," SPE 116328, Society of Petroleum Engineers (SPE), SPE International, presented at the 2008 SPE Annual Technical Conference and Exhibition, Sep. 21-24, 2008, 16 pages.
Zhao et al., "Chromatographic Separation of Highly Soluble Diamond Nanoparticles Prepared by Polyglycerol Grafting," Angewandte Chemie International Edition, Feb. 7, 2011, 50:6 (1388-1392), 5 pages.
Zhao et al., "Advanced Compound Coating for Delaying Corrosion of Fast-Dissolving Alloy in High Temperature and Corrosive Environment", International Scholarly and Scientific Research & Innovation, 2021, 15(2):71-75, 5 pages.
Zheng et al., "Ultralight, ultrastiff mechanical metamaterials," Science, Jun. 2014, 344(6190):1373-1377, 6 pages.

* cited by examiner

UNTETHERED LOGGING DEVICES AND RELATED METHODS OF LOGGING A WELLBORE

TECHNICAL FIELD

This disclosure relates to untethered devices, such as untethered logging devices that include a buoyancy device with a relatively buoyant attachment plate and a degradable ballast weight.

BACKGROUND

Untethered devices in oil and gas applications refer to untethered logging, intervention, stimulation, or other devices that are unattached to a wellbore surface and are deposited in a wellbore to descend in a downhole direction. Such an untethered device may include a release mechanism whereby an exposed ballast weight degrades or is released at a downhole depth along the wellbore to reduce a density of untethered device for allowing the untethered device to float back upward to the surface. The release mechanism may include an attachment plate that, owing to its weight, settles permanently in a bottomhole region of the wellbore. An accumulation of such attachment plates at the bottomhole region (e.g., especially because the attachment plates do not erode quickly) can lead to wellbore cluttering, which is hinders various wellbore interventions and bottomhole operations. Furthermore, heat produced by the highly exothermic reaction undergone by the exposed ballast weight can permanently damage the other components of the untethered device while attached to the ballast weight.

SUMMARY

This disclosure relates to untethered logging devices that include a buoyancy device with a relatively buoyant attachment plate and a degradable ballast weight. Upon release of the buoyancy device from a remaining functional module of the untethered logging device, the functional module floats in an uphole direction towards the surface. Upon sufficient degradation of the degradable ballast weight of the buoyancy device, the attachment plate floats in the uphole direction towards the surface. The functional module of the untethered logging devices are designed to log the wellbore while flowing in both downhole and uphole directions within the wellbore.

In one aspect, an untethered device includes a housing, a magnetic actuator that is coupled to the housing, and a buoyancy device. The buoyancy device includes an attachment plate that is securable to the magnetic actuator, a degradable ballast weight that is coupled to the attachment plate, and a buoyancy-enhancing feature that is positioned adjacent to the attachment plate.

Embodiments may provide one or more of the following features.

In some embodiments, the buoyancy-enhancing feature includes a buoyant material layer.

In some embodiments, the buoyant material layer is disposed between the attachment plate and the degradable ballast weight.

In some embodiments, the buoyant material layer includes a syntactic foam.

In some embodiments, the degradable ballast weight is attached directly to the buoyant material layer.

In some embodiments, the buoyancy device is separable as an entire unit from the magnetic actuator.

In some embodiments, components of the buoyancy device are secured to one another via one or more mechanical fasteners.

In some embodiments, components of the buoyancy device are secured to one another via one or more adhesive substances.

In some embodiments, the buoyancy-enhancing feature includes void regions within the attachment plate.

In some embodiments, the attachment plate is attached directly to the degradable ballast weight.

In some embodiments, the degradable ballast weight is non-magnetic.

In some embodiments, the untethered device further includes one or more sensors configured to measure one or more properties within a surrounding wellbore.

In some embodiments, the untethered device is configured to continuously log the surrounding wellbore while the untethered device flows in a downhole direction and while the untethered device flows in an uphole direction.

In some embodiments, the untethered device is an untethered logging device.

In another aspect, a method of logging a wellbore includes dropping an untethered logging device in a downhole direction through the wellbore. In some embodiments, the untethered logging device includes a functional module including a magnetic actuator, an attachment plate that is equipped with a buoyancy-enhancing feature and coupled to the magnetic actuator, and a degradable ballast weight that is attached to the attachment plate. The method further includes releasing the attachment plate from the magnetic actuator to reduce a bulk density of the untethered logging device and flowing the functional module of the untethered logging device in an uphole direction through the wellbore.

Embodiments may provide one or more of the following features.

In some embodiments, the method further includes allowing the degradable ballast weight to degrade to reduce a bulk density of an assembly of the degradable ballast weight and the attachment plate and flowing the attachment plate in the uphole direction through the wellbore.

In some embodiments, the buoyancy-enhancing feature includes a buoyant material layer.

In some embodiments, the buoyant material layer includes a syntactic foam.

In some embodiments, the buoyancy-enhancing feature includes void regions within the attachment plate.

In some embodiments, the method further includes measuring one or more properties within the wellbore while the functional module flows in the downhole direction and in the uphole direction.

The details of one or more embodiments are set forth in the accompanying drawings and description. Other features, aspects, and advantages of the embodiments will become apparent from the description, drawings, and claims.

DETAILED DESCRIPTION

Figure 1:
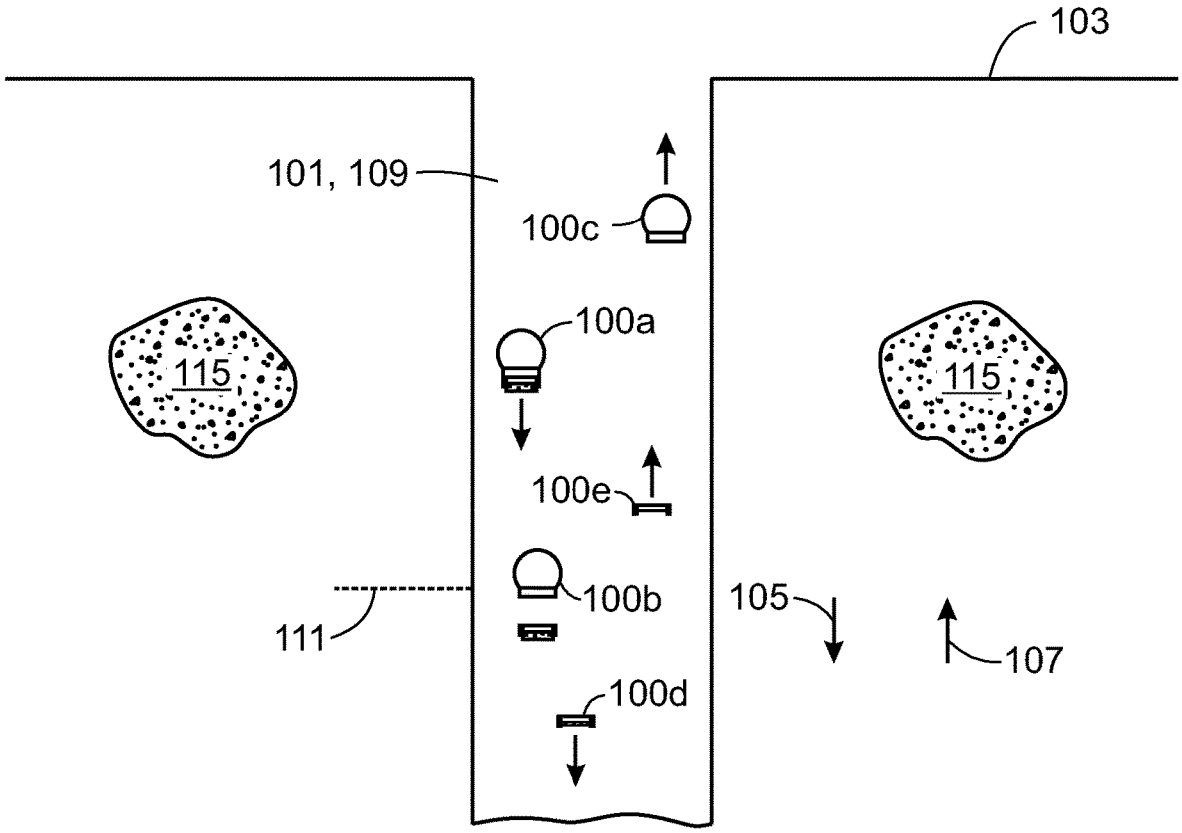
FIG. 1 is a diagram of example untethered logging devices within a wellbore.

FIG. 1 illustrates several states of example untethered logging devices 100 (e.g., 100*a*, 100*b*, 100*c*, 100*d*, 100*e*) for measuring properties (e.g., collecting data) along a wellbore 101 to log the wellbore 101. Such properties may be related to one or both of wellbore fluid 109 within the wellbore 101 or a rock formation 115 in which the wellbore 101 is formed. The untethered logging devices 100 are unattached (e.g., either directly or indirectly) to a surface 103 from which the wellbore 101 extends. The untethered logging devices 100 are deployable to the wellbore 101 to flow in a downhole direction 105 through the wellbore fluid 109 while logging the wellbore 101 (e.g., refer to 100*a*), to sufficiently increase their buoyancy when the untethered logging devices 100 reach a target depth 111 along the wellbore 101 (e.g., refer to 100*b*), and to consequently flow in an uphole direction 107 through the wellbore fluid 109 towards the surface 103 while logging the wellbore 101 (e.g., refer to 100*c*).

Figure 2:
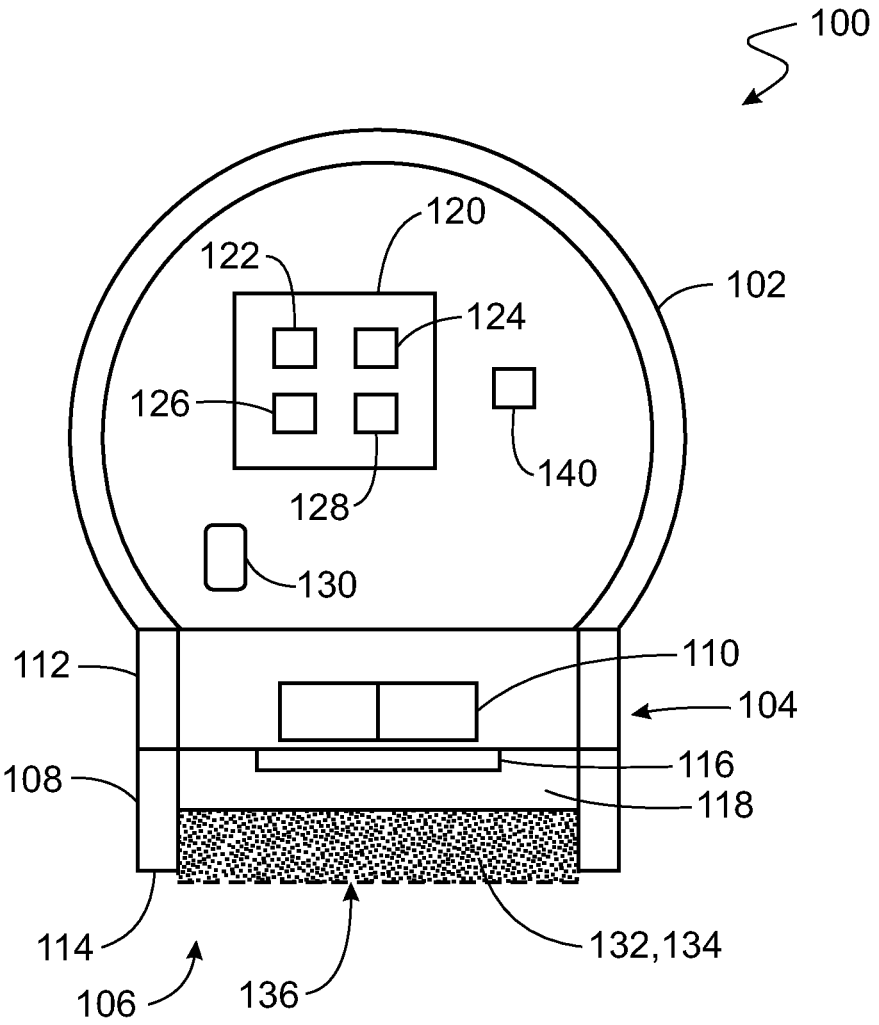
FIG. 2 is a cross-sectional view of an example untethered logging device of FIG. 1, including a buoyant layer that is secured between an attachment plate and a ballast weight.

FIG. 2 illustrates a cross-sectional view of an example untethered logging device 100. The untethered logging device 100 includes a main housing 102 that contains or otherwise protects various internal components, an electromagnetic activation unit 104 disposed adjacent to the main housing 102, a buoyancy device 106 that is coupled to the electromagnetic activation unit 104, and a protective wall 108 that surrounds the buoyancy device 106 laterally. The main housing 102 has a substantially frusto-spherical shape (e.g., the shape of a partial sphere) such that the untethered logging device 100 may sometimes be referred to as a sensor ball. The electromagnetic activation unit 104 includes a magnetic actuator 110 and a substantially cylindrical wall 112 that protects the magnetic actuator 110. The main housing 102 and the electromagnetic activation unit 104 together form a functional module of the untethered logging device 100. The buoyancy device 106 is substantially disc-shaped (e.g., shaped substantially as a solid cylinder), and the protective wall 108 accordingly has a substantially cylindrical shape. The protective wall 108 is open at a downhole end 114 such that the buoyancy device 106 is exposed to the wellbore fluid 109 at all times.

The buoyancy device 106 includes an attachment plate 116, a buoyant layer 118, and a ballast weight 132. The attachment plate 116 is a metal plate that is made of one or more ferromagnetic materials, such as high-permeability, soft ferromagnetic materials (e.g., carbon steels or nickel-iron alloys). The resulting attractive force between the attachment plate 116 and the magnetic actuator 110 ensures that the attachment plate 116 remains secured to the magnetic actuator 110 until the magnetic actuator 110 is operated to release the entire buoyancy device 106 as a unit from the electromagnetic activation unit 104 of the untethered logging device 100 (e.g., refer to 100*b* in FIG. 1) at the target depth 111 (e.g., a preprogrammed depth that is detected based on a sensor measurement). Upon release of the buoyancy device 106 from the electromagnetic activation unit 104, an overall (e.g., bulk) density of the untethered logging device 100 decreases (e.g., instantaneously) to a value that is less than that of the wellbore fluid 109. Accordingly, the untethered logging device 100 (e.g., the functional module remaining after release of the buoyancy device 106) is buoyant enough to float in the uphole direction 107 (e.g., refer to 100*c* in FIG. 1) to be retrieved at the surface 103. In this way, connection or disconnection of the buoyancy device 106 governs whether the untethered logging device 100 descends (e.g., sinks) in the downhole direction 105 or ascends (e.g., floats upward) in the uphole direction 107 through the wellbore fluid 109.

While the remaining functional module of untethered logging device 100 floats upward, the buoyancy device 106 continues to descend as a unit toward the bottomhole end 113 of the wellbore 101 (e.g., refer to 100*d* in FIG. 1). While the buoyancy device 106 remains in the wellbore 101, the ballast weight 132 gradually degrades over an extended period of time (e.g., several hours to several days). Once the ballast weight 132 degrades to the extent that the overall density of the buoyancy device 106 is less than that of the wellbore fluid 109, the buoyancy device 106 begins to float in the uphole direction 107 towards the surface 103 (refer to 100*e* in FIG. 1). In some examples, a minimal volume of the ballast weight 132 is still attached to the attachment plate 116 once the buoyance device 106 reaches the surface 103. In other examples, the ballast weight 132 has degraded substantially entirely by the time the buoyancy device 106 reaches the surface. 103.

In this way, a state of the ballast weight 132 (e.g., the extent to which the ballast weight 132 has degraded) governs whether the buoyancy device 106 descends in the downhole direction 105 or ascends in the uphole direction 107 through the wellbore fluid 109. For example, when the state of the ballast weight 132 is such that the bulk density of the buoyancy device 106 is greater than the density of the wellbore fluid 109, there is a positive differential in density that renders the buoyancy device 106 relatively non-buoyant, causing the buoyancy device 106 to descend through the wellbore fluid 109 in the downhole direction 105. In contrast, when the state of the ballast weight 132 is such that the overall density of the buoyancy device 106 is less than the density of the wellbore fluid 109, there is a negative differential in density that renders the buoyancy device 106 relatively buoyant, causing the buoyancy device 106 to ascend through the wellbore fluid 109 in the uphole direction 107 for retrieval at the surface 103.

Referring still to FIG. 2, the ballast weight 132 includes a solid core 134 that may be made of one or more non-magnetic materials, such as aluminum, magnesium, and a metal-polymer composite material. The ballast weight 132 also includes a coating 136 that initially surrounds an exposed exterior surface of the solid core 134 to delay or otherwise extend the degrading process of the solid core 134. A presence of the coating 136 may ensure that the untethered logging device 100 sinks to the target depth 111 before the solid core 134 can sufficiently degrade to critically reduce the overall density of the untethered logging device 100. The coating 136 may be made of one or more materials, such as a polymer (e.g., epoxy or xylan) or an oxide (e.g., alumina or silica). The coating 136 may be applied to the solid core 134 by utilizing one or more conventional techniques, such as dip coating, spray coating, anodization, electrodeposition, or vapor deposition.

The buoyant layer 118 is positioned between the attachment plate 116 and the ballast weight 132. The buoyant layer 118 is made of one or more relatively low-density materials to lower an overall density of the buoyancy device (e.g., an effective density of the attachment plate 116). The buoyant layer 118 accordingly increases an overall buoyancy of the buoyancy device 106. For example, the effect of the buoyant layer 118 is that, once the ballast weight 132 has sufficiently degraded (e.g., by about 10% or more), the overall density of the buoyancy device 106 (e.g., an assembly of the attachment plate 116, the buoyant layer 118, and any small volume of remaining ballast weight 132) is low enough (e.g., less than that of the wellbore fluid 109) to cause the buoyancy device 106 to float in the uphole direction 107 back to the surface 103.

In some embodiments, the buoyant layer 118 is made a syntactic foam. In some embodiments, the buoyant layer 118 has a density between about 0.5 g/cm$^3$ and 0.7 g/cm$^3$, a hydrostatic crush pressure resistance between about 2,000 psi and about 30,000 psi, a compressive modulus between about 100,000 psi and about 900,000 psi, a glass transition point above about 150° C., and a thermal conductivity between about 0.05 W/m-K and about 0.5 W/m-K. In some embodiments, the buoyancy layer has a thickness (e.g., a vertical height) between about 0.5 cm and about 5 cm.

Figure 3:
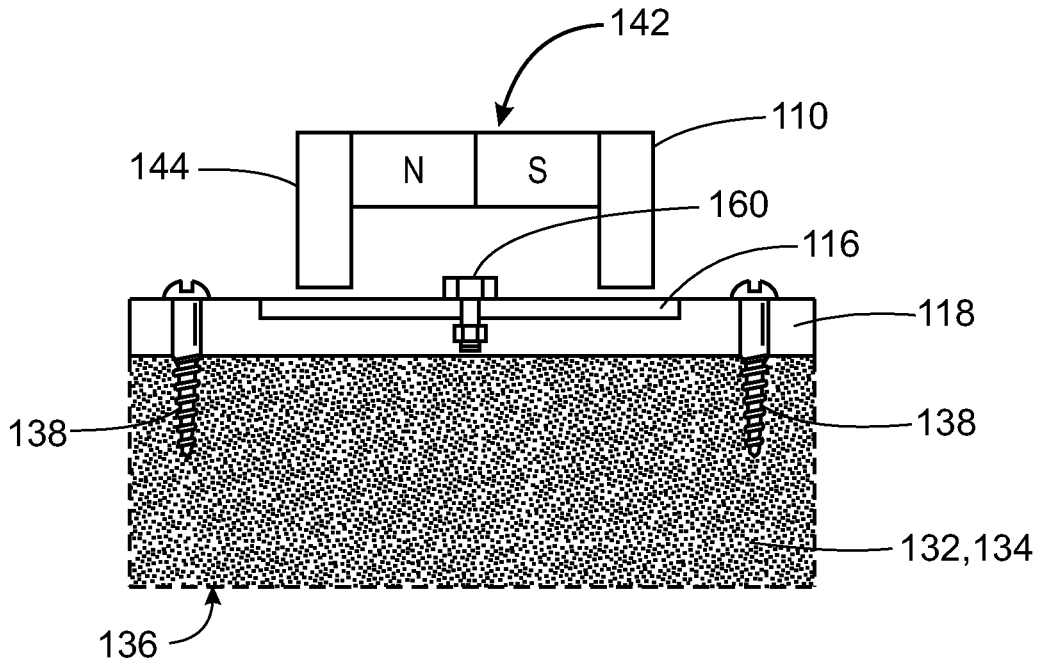
FIG. 3 is an enlarged view of a buoyancy device of the untethered logging device of FIG. 2, including the buoyant layer, attachment plate, and ballast weight of FIG. 2.

Referring to FIG. 3, the components of the buoyancy device 106 are secured to one another via multiple fasteners (e.g., screws, bolts, or nuts) that are resistant to a relatively high-temperature environment of the wellbore 101. For example, the buoyant layer 118 is secured to the ballast weight 132 with one or more screws 138, and the buoyant layer 118 is secured to the attachment plate 116 with one or more bolt-and-nut combinations 160. In other embodiments, the components of the buoyancy device 106 may alternatively or additionally be secured to one another via adhesives (e.g., between the attachment plate 116 and the buoyant layer 118 and between the buoyant layer 118 and the ballast weight 132). Example adhesives that may be used include super glue, polyurethane, and silicone. In either case of fasteners or adhesives, the attachment plate 116 is permanently secured to the buoyant layer 118. By carefully engineering details of the one or more fasteners (e.g., length, diameter, thread count, and size) or surface areas of any applied adhesives, attachment of the components of the buoyancy device 106 to one another may be ensured.

Advantageously, as compared to conventional logging devices with ballast-release systems, the design aspects of the buoyant layer 118 avoid multiple interventions that may otherwise need to be performed at the wellbore 101 to recover the attachment plate 116 from the bottomhole region 113 of the wellbore 101 In this manner, the buoyant layer 118 prevents clutter resulting from attachment plates 116 that may otherwise accumulate at the bottomhole end region 113. Accordingly, the buoyant layer 118 provides the untethered logging device 100 with a zero-waste feature that results in safer and cleaner well operations. Additional advantages arise from the buoyant layer 118 as well. For example, the buoyant layer 118 serves as a shock absorber for the other components of the untethered logging device 100 while the untethered logging device 100 descends through the wellbore 101. The buoyant layer 118 also serves as a thermal shield that protects the other components of the untethered logging device 100 from the highly exothermic degradation (e.g., dissolving) process gradually undergone by the ballast weight 132.

Referring again to FIG. 2, the example untethered logging device 100 further includes circuitry 120 that controls various functionalities of the untethered logging device 100. In some embodiments, the circuitry 120 includes a receiver 122, a transmitter 124, a controller 126, and one or more processors 128. The untethered logging device 100 also includes a battery 130 that powers various components of the untethered logging device 100. The magnetic actuator 110 is magnetized by the battery 130 to hold the buoyancy device 106 at the attachment plate 116 until a detected parameter triggers deactivation for release of the buoyancy device 106. Referring to FIG. 3, the magnetic actuator 110 includes a magnet 142 and two magnetic steel poles 144. The magnet 142 includes a low coercivity magnet with a coil wrapped around it and a high coercivity magnet. By applying brief current pulses to the coil, a pull force can be effected to hold the attachment plate 116 of the buoyancy device 106.

The untethered logging device 100 includes also one or more sensors 140 that are continuously powered by the battery 130 and designed to measure one or more physical, chemical, geological, or structural properties along the wellbore 101 to log the wellbore 101 continuously and in real time. Example properties include elapsed time, temperature, pressure, fluid density, fluid viscosity, fluid flow rate, magnetic field, gamma ray intensity, tool acceleration, tool rotation, and other parameters. The continuous measurements are acquired while the untethered logging device 100 both descends and ascends through the wellbore fluid 109. During the logging operation, the transmitter 124 sends data carrying the real-time measurements to one or more devices located at the surface 103 for further processing of the data.

In some embodiments, a weight of the untethered logging device 100, excluding the ballast weight 132, is in a range of about 25 g to about 500 g. In some embodiments, the ballast weight 132 weighs between about 10 g and about 300 g. Measured to the downhole end 114 of the protective wall 108, the untethered logging device 100 typically has a total height of about 5 cm to about 30 cm. The untethered logging device 100 typically has a width (e.g., determined by a diameter of the main housing 102) of about 5 cm to about 10 cm. Each of the main housing 102, the closed wall 112, and the protective wall 108 may be made of one or more materials, such as metals (e.g., steel, titanium, or nickel-chromium-based alloys), syntactic foam, thermoplastics, and carbon fiber materials.

Figure 4:
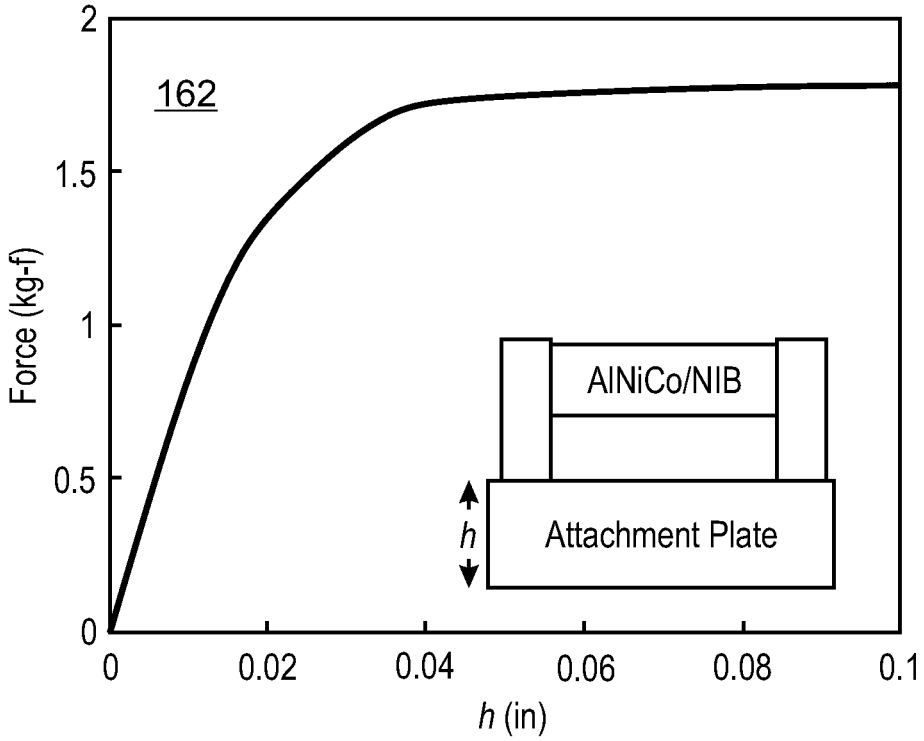
FIG. 4 is a graph of an example relationship between a thickness of the attachment plate of FIG. 2 and a holding force on the attachment plate.

Additionally, there are at least two other important parameters that should be considered with respect to the design of the untethered logging device 100. These parameters include a thickness of the attachment plate 116 and an effective density of an assembled combination of the attachment plate and the buoyant layer 118 (e.g., a combined layer 148). The thickness of the attachment plate 116 determines a holding force that can be exerted by a combined effect of the magnetic actuator 110, a magnetic field strength of the magnet 142, and a magnetic permeability of the ferromagnetic material from which the attachment plate 116 is made. If the attachment plate 116 is thinner than a critical thickness, then the magnetic field saturates the attachment plate 116, thereby greatly reducing its magnetic permeability. As a result, a reluctance of the attachment plate 116 increases, and an affinity that allows the magnetic field to remain inside of the attachment plate 116 is reduced. This reduced affinity causes the magnetic field to leak such that the holding force applied to the attachment 116 plate is reduced. FIG. 4 provides a graph 162 of an example relationship between a plate thickness and a holding force that was generated using a finite element modeling simulation.

In order for the untethered logging device 100 to reach the target depth 111, the combined layer 148 should be less buoyant than the wellbore fluid 109 (e.g., having a density of about 1.0 g/cm$^3$ for water and a density of about 0.75-0.9 cm$^3$ for oil). For example, for the combined layer 148 to have an effective density of about 0.85 g/cm$^3$, a steel attachment plate 116 of about 2 cm$^3$ (e.g., having a density of about 7.85 g/cm$^3$) would require a buoyant layer 118 of about 70 cm$^3$ (e.g., having a density of about 0.65 g/cm$^3$) or about 16 cm$^3$ of trapped air.

Figure 5:
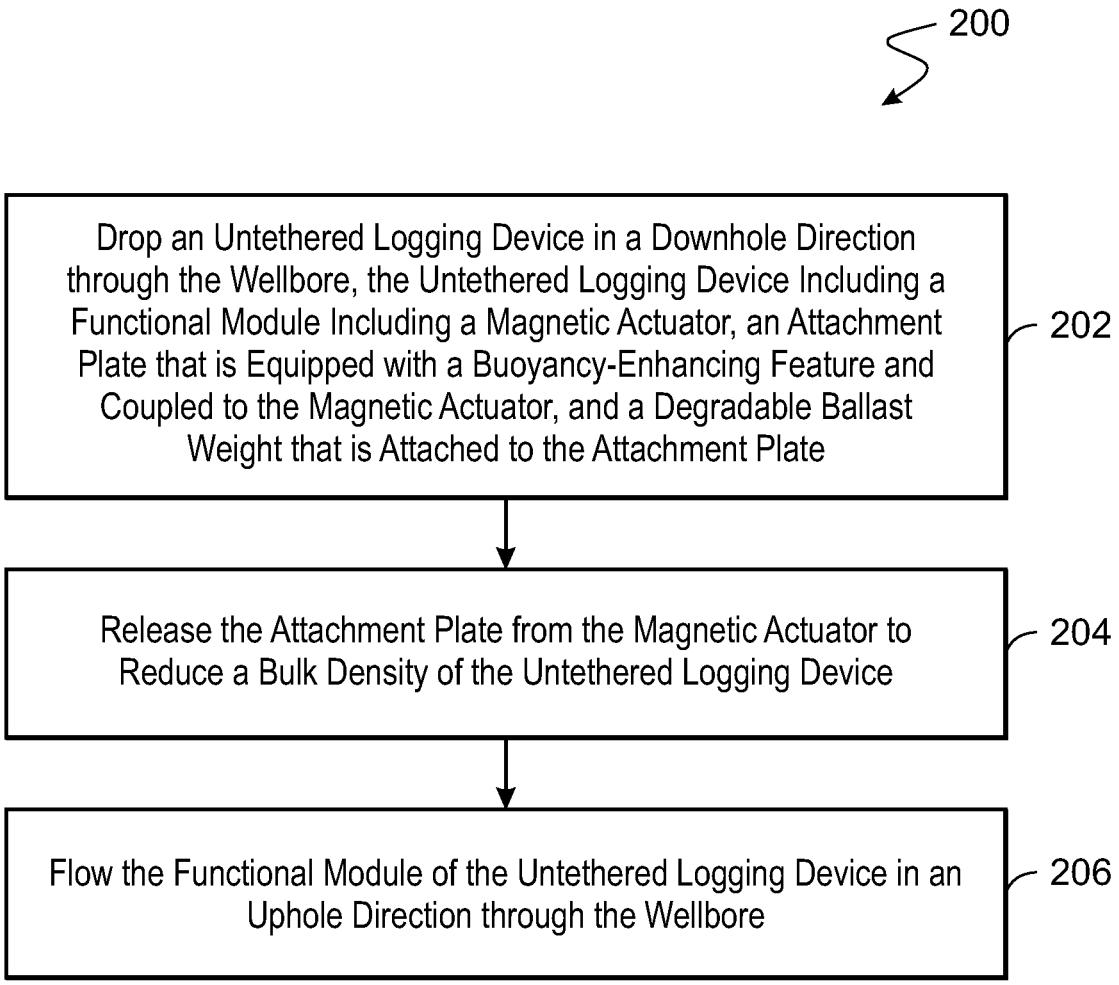
FIG. 5 is a flow chart illustrating an example method of logging a wellbore using an untethered logging device of FIG. 2 or an untethered logging device of FIG. 6.

FIG. 5 is a flow chart illustrating an example method 200 of logging a wellbore (e.g., the wellbore 101). In some embodiments, the method 200 includes a step 202 for dropping an untethered logging device (e.g., the untethered logging device 100, 300) in a downhole direction (e.g., the downhole direction 105) through the wellbore. In some embodiments, the untethered logging device includes a functional module (e.g., an assembly of the main housing 102 and the electromagnetic activation unit 104) including a magnetic actuator (e.g., the magnetic actuator 110), an attachment plate (e.g., the attachment plate 116, 316) that is equipped with a buoyancy-enhancing feature (e.g., the buoyant layer 118 or the void regions 358) and coupled to the magnetic actuator, and a degradable ballast weight (e.g., the ballast weight 132) that is attached to the attachment plate. In some embodiments, the method 200 includes a step 204 for releasing the attachment plate from the magnetic actuator to reduce a bulk density of the untethered logging device. In some embodiments, the method 200 includes a step 206 for flowing the untethered logging device in an uphole direction (e.g., the uphole direction 107) through the wellbore.

While the untethered logging device 100 has been described and illustrated with respect to certain dimensions, sizes, shapes, arrangements, materials, and methods 200, in some embodiments, an untethered logging device that is similar in construction and function to the untethered logging device 100 may include one or more different dimensions, sizes, shapes, arrangements, configurations, and materials or may be utilized according to different methods.

Figure 6:
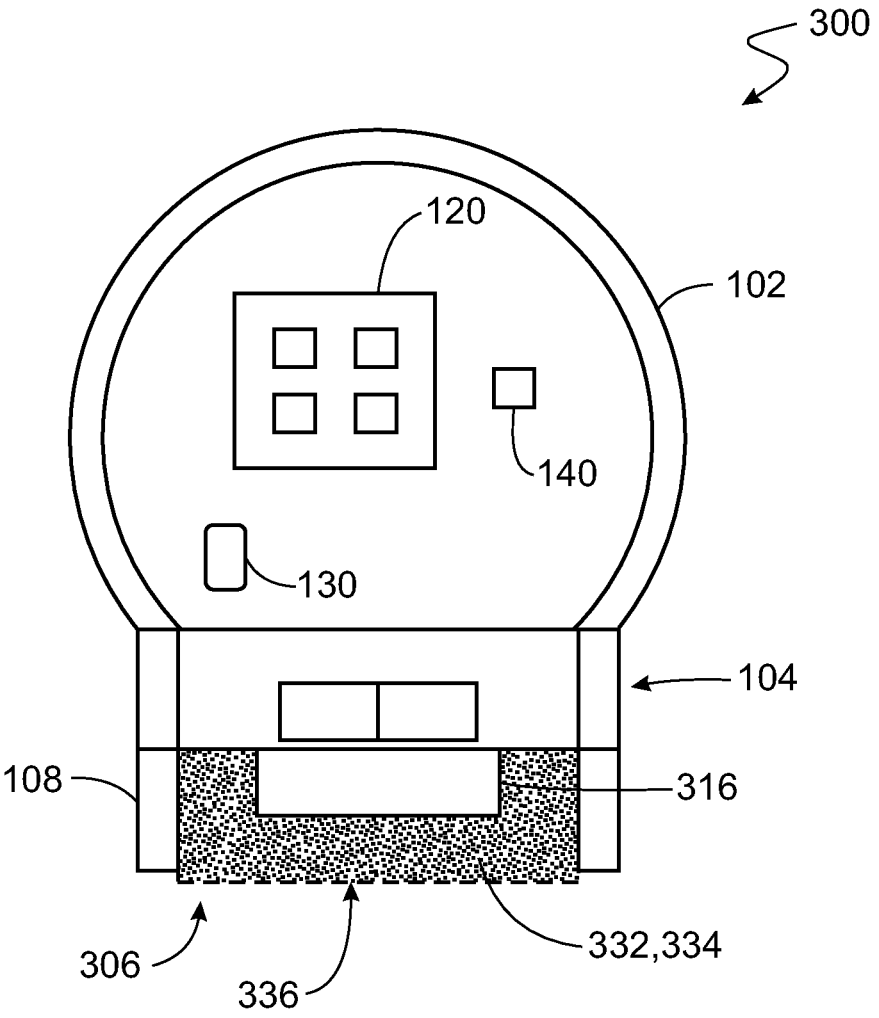
FIG. 6 is a cross-sectional view of an example untethered logging device, including a ballast weight and an attachment plate with void regions.
Figure 7:
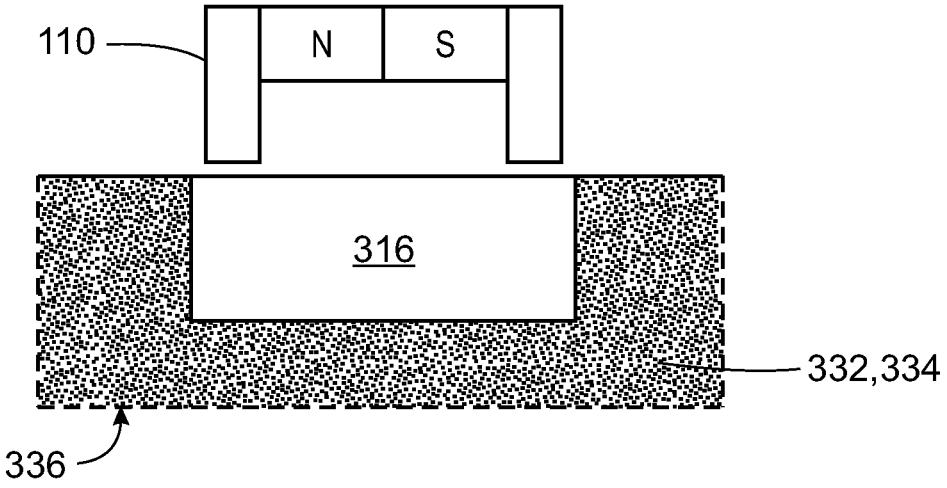
FIG. 7 is an enlarged view of a buoyancy device of the untethered logging device of FIG. 6, including the ballast weight and the attachment plate of FIG. 6.

For example, FIG. 6 illustrates an example untethered logging device 300 that includes a different type of buoyancy device 306. The untethered logging device 300 is otherwise substantially similar in construction and function to the untethered logging device 100 and may be utilized according to the method 200. Accordingly, the untethered logging device 300 includes the main housing 102, the electromagnetic activation unit 104, the protective wall 108, the circuitry 120, the battery 130, and the one or more sensors 140. Referring to FIG. 7, the buoyancy device 306 includes a ballast weight 332 and an attachment plate 316 that is in direct contact with the ballast weight 332 along three sides. The ballast weight 332 is otherwise substantially similar in construction and function to the ballast weight 132 (e.g., including a solid core 234 and a coating 236), except that it has a different profile to accommodate a different profile of the attachment plate 316.

Figure 8:
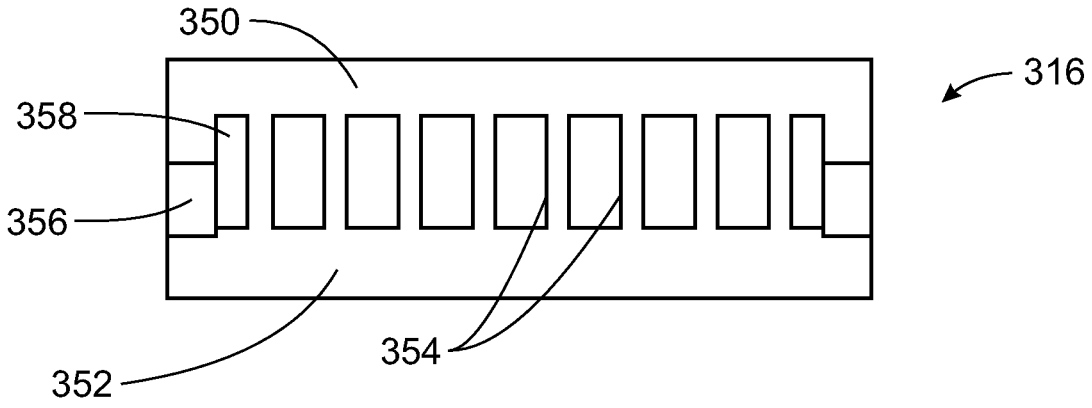
FIG. 8 is an enlarged view of the attachment plate of FIG. 6.

Referring to FIG. 8, the attachment plate 316 is a metal attachment plate that is made of the one or more ferromagnetic materials discussed above with respect to the attachment plate 116 to ensure that the attachment plate 316 remains secured to the magnetic actuator 110 until the electromagnetic unit 104 is actuated to release the buoyancy device 306. Instead of utilizing the buoyant layer 118 to increase an overall buoyancy of the attachment plate 316, the attachment plate 316 relies on its structural design. For example, the attachment plate 316 includes an upper portion 350, a lower portion 352, columns 354 that extend between the upper and lower portions 350, 352, and an o-ring that 356 that substantially eliminates any outer gaps between the upper and lower portions 350, 352.

The upper and lower portions 350, 352 and the columns 354 together form multiple void regions 358 (e.g., air pockets) that reduce an overall weight (e.g., and therefore an effective density) of the attachment plate 316 as a result of material removal. The columns 354 together provide an internal truss structure that can resist relatively high crush pressures while still allowing for a relatively low density of the attachment plate 316. In some embodiments, the attachment plate 316 may be made by bring multiple pieces together or by employing additive manufacturing. A thickness and an effective density of the attachment plate 316 are critical factors for proper functioning of the attachment plate 316, as discussed above with respect to the attachment plate 116, the combined layer 148, and relationship shown in FIG. 4.

While the device 100 has been described as an untethered logging device, in some embodiments, another type of untethered device that is otherwise similar in construction and function to the device 100 can include the ballast weight-release mechanisms described above. Such devices include intervention devices, stimulation devices, and other types of untethered devices.

Other embodiments are also within the scope of the following claims.

What is claimed is:

1. An untethered device comprising:
- a housing;
- a magnetic actuator that is coupled to the housing; and
- a buoyancy device comprising:
  - an attachment plate that is securable to the magnetic actuator,
  - wherein the attachment plate is equipped with a buoyancy-enhancing feature, and
  - a degradable ballast weight that is coupled to the attachment plate,
  - wherein the degradable ballast weight degrades to reduce a bulk density of the buoyancy device such that the attachment plate floats towards a surface.

2. The untethered device of claim 1, wherein the buoyancy-enhancing feature comprises a buoyant material layer.

3. The untethered device of claim 2, wherein the buoyant material layer is disposed between the attachment plate and the degradable ballast weight.

4. The untethered device of claim 2, wherein the buoyant material layer comprises a syntactic foam.

5. The untethered device of claim 2, wherein the degradable ballast weight is attached directly to the buoyant material layer.

6. The untethered device of claim 5, wherein the buoyancy device is separable as an entire unit from the magnetic actuator.

7. The untethered device of claim 1, wherein components of the buoyancy device are secured to one another via one or more mechanical fasteners.

8. The untethered device of claim 1, wherein components of the buoyancy device are secured to one another via one or more adhesive substances.

9. The untethered device of claim 1, wherein the buoyancy-enhancing feature comprises void regions within the attachment plate.

10. The untethered device of claim 9, wherein the attachment plate is attached directly to the degradable ballast weight.

11. The untethered device of claim 1, wherein the degradable ballast weight is non-magnetic.

12. The untethered device of claim 1, further comprising one or more sensors configured to measure one or more properties within a surrounding wellbore.

13. The untethered device of claim 1, wherein the untethered device is configured to continuously log a surrounding wellbore while the untethered device flows in a downhole direction and while the untethered device flows in an uphole direction.

14. The untethered device of claim 1, wherein the untethered device comprises an untethered logging device.

15. A method of logging a wellbore, the method comprising:

dropping an untethered logging device in a downhole direction through the wellbore, the untethered logging device comprising:

a functional module comprising a magnetic actuator, an attachment plate that is equipped with a buoyancy-enhancing feature and coupled to the magnetic actuator, and a degradable ballast weight that is attached to the attachment plate;

releasing the attachment plate from the magnetic actuator to reduce a bulk density of the untethered logging device;

flowing the functional module of the untethered logging device in an uphole direction through the wellbore;

allowing the degradable ballast weight to degrade to reduce a bulk density of an assembly of the degradable ballast weight and the attachment plate; and flowing the attachment plate in the uphole direction through the wellbore.

16. The method of claim 15, wherein the buoyancy-enhancing feature comprises a buoyant material layer.

17. The method of claim 16, wherein the buoyant material layer comprises a syntactic foam.

18. The method of claim 15, wherein the buoyancy-enhancing feature comprises void regions within the attachment plate.

19. The method of claim 15, further comprising measuring one or more properties within the wellbore while the functional module flows in the downhole direction and in the uphole direction.

* * * * *